US006957514B2

(12) United States Patent
Castellon

(10) Patent No.: US 6,957,514 B2
(45) Date of Patent: Oct. 25, 2005

(54) DRIVING MEMBER FOR USE IN CONNECTION WITH A MOTOR VEHICLE POWER WINDOW

(76) Inventor: Melchor D. Castellon, Diputacion, 455-457, E-08013 Barcelona (ES)

( * ) Notice: Subject to any disclaimer, the term of this patent is extended or adjusted under 35 U.S.C. 154(b) by 0 days.

(21) Appl. No.: 10/483,080

(22) PCT Filed: May 6, 2003

(86) PCT No.: PCT/ES03/00196

§ 371 (c)(1),
(2), (4) Date: Jan. 8, 2004

(87) PCT Pub. No.: WO03/097975

PCT Pub. Date: Nov. 27, 2003

(65) Prior Publication Data

US 2004/0168372 A1 Sep. 2, 2004

(30) Foreign Application Priority Data

May 16, 2002 (ES) ..... 200201108

(51) Int. Cl.[7] ..... E05F 15/16
(52) U.S. Cl. ..... 49/375; 49/349
(58) Field of Search ..... 49/375, 372, 352, 49/374, 349, 348

(56) References Cited

U.S. PATENT DOCUMENTS 4,663,901 A * 5/1987 Ichinohe ..... 52/127.3
4,762,904 A 8/1988 Nakama
5,513,468 A 5/1996 Diestelmeier
5,987,820 A 11/1999 Shibanushi
6,349,504 B1 * 2/2002 Schmitt ..... 49/375
6,453,617 B1 * 9/2002 Klippert et al. ..... 49/375
6,557,302 B1 * 5/2003 Kaps ..... 49/375

FOREIGN PATENT DOCUMENTS

GB 2095317 9/1982
WO WO-99/57400 11/1999

* cited by examiner

*Primary Examiner*—Gregory J. Strimbu
(74) *Attorney, Agent, or Firm*—Dickstein, Shapiro, Morin & Oshinsky, LLP.

(57) ABSTRACT

A driving member for a power window device of a motor vehicle has a U-shaped body (1) formed of two body-halves (2, 3) joined to each other by one of their ends, the body halves defining an interior portion (4) adapted to receive the lower end of a window pane of the vehicle. The U-shaped body (1) is adapted to be slidingly driven by a driving cable along a rail of the power window device, and the interior portion (4) of the body (1) is provided with parallel longitudinal protrusions (5) disposed in a stepped arrangement. The arrangement forms a first series of protrusions (6) which extend upwardly relative the window pane and a second series of protrusions (7) which extend downwardly relative the window pane both series (6, 7) of protrusions (5) being symmetrical so that the window pane rests on one of the series (6) slightly sloped according to the position that the window pane assumes in the power window device. The driving member being capable of be used for the window pane of the door on either side of the vehicle.

6 Claims, 1 Drawing Sheet

DRIVING MEMBER FOR USE IN CONNECTION WITH A MOTOR VEHICLE POWER WINDOW

BACKGROUND OF THE INVENTION

The window panes in motor vehicles are usually driven through power window devices fitted inside the doors of the vehicle. Said devices may act, either manually or by means of an electric motor, on driving cables running through a guide thus driving the window pane of the vehicle up or down by means of at least a driving or sliding member by way of a clamp that holds the lower end of the window pane and which runs through the guide rail or rails.

Prior art driving members are known formed of a U-shaped body which is adapted to catch the lower edge of the window pane. Said driving members may be made of plastic or metal, in which case they include rubber edges to avoid damaging the window pane. Since the window panes in current motor vehicles exhibit a curved surface, different driving members should be designed for both sides of the motor vehicle.

SUMMARY OF THE INVENTION

The present invention is focused to a new driving member with which reducing costs, reducing the number of parts and also reducing, therefore, the assembly tolerances may be possible since the same driving member configuration may be used for the doors of either side of the motor vehicle, providing further advantages from the features that will be herein described according to the invention.

The driving member of the present invention generally comprises a body made of plastic or any other suitable material. Said body has a clamp-like U-shaped configuration, formed of two body halves joined to each other by one of their ends. The interior of said body is adapted to receive the inner edge of the window pane of the vehicle. As it has been stated before, the driving member is slidingly driven by a driving cable along the rail of the power window device.

The main feature of the driving member for power window devices of motor vehicles of the present invention is that the interior portion of said body which is in contact with the inner end of the window pane of the vehicle is provided with parallel longitudinal protrusions. These longitudinal parallel protrusions are disposed in a stepped arrangement forming an upward series of protrusions and a downward series of protrusions, both series being symmetrical. The window pane thereby rests on one of said series slightly sloped according to the position that it assumes in the power window device, the same driving member being able to be used for the window pane of the door of the other side of the vehicle resting on the other of said series of protrusions.

Said parallel longitudinal protrusions are conveniently designed to reduce the tolerances between the surface of contact of the window pane and the driving member, the window pane being correctly adjusted therein.

With the symmetrical configuration of the interior of the slider it is possible to significantly reduce the production costs as one driving member type is valid for both sides of the motor vehicle.

On the other hand, the invention makes also provision that one of the two body halves defining the U-shaped body of the driving member has a transverse groove intended to resiliently conform the end of said body where the window pane exists to the curvature thereof.

As the window pane of motor vehicle is usually a curved surface, as it has been explained before, the portion where the window pane exists outside the driving member may correctly conform to said curvature without forcing the geometry of the driving member body, thus also allowing a better assembling of the assembly.

According to a further advantageous feature of the invention, in the other of said body halves of the driving member body, either a threaded hole or a cavity is provided to fit a nut. This threaded hole is provided to match with a hole formed in the lower end of the window pane. A screw holding the window pane caught between the two body halves of the driving member may pass through said holes. The hole of the driving member is smaller than the hole of the window with the purpose of absorbing tolerances between rails. With this feature a more flexible assembly of the power window device is obtained.

The body of the driving member is also provided with a circular end of travel stop which is positioned centered with the stop member of the power window device and the circular section of the rail. Therefore, although the driving member is rotated, the end of travel will remain centered.

BRIEF DESCRIPTION OF THE DRAWINGS

A preferred embodiment of a driving member for power window devices of motor vehicle according to the present invention will be now described in detail and by way of a non limitative example, from which the features and the advantages thereof will be clearer. The description that follows is given with reference to the drawings that are herein accompanied, in which.

A detailed list of the various parts cited in the present patent application is given below:

(1) body of the driving member;
(2) body half;
(3) body half;
(4) interior portion of the body of the driving member;
(5) parallel longitudinal protrusions;
(6) upward series of protrusions
(7) downward series of protrusions;
(8) frontal transverse groove
(9) cavity for a nut; and
(10) end of travel stop.

DETAILED DESCRIPTION OF THE INVENTION

An embodiment of a driving member of a power window device for motor vehicles, which may be applied both for manual power window devices and for automatically driven power window devices is described hereinbelow.

Figure 1:
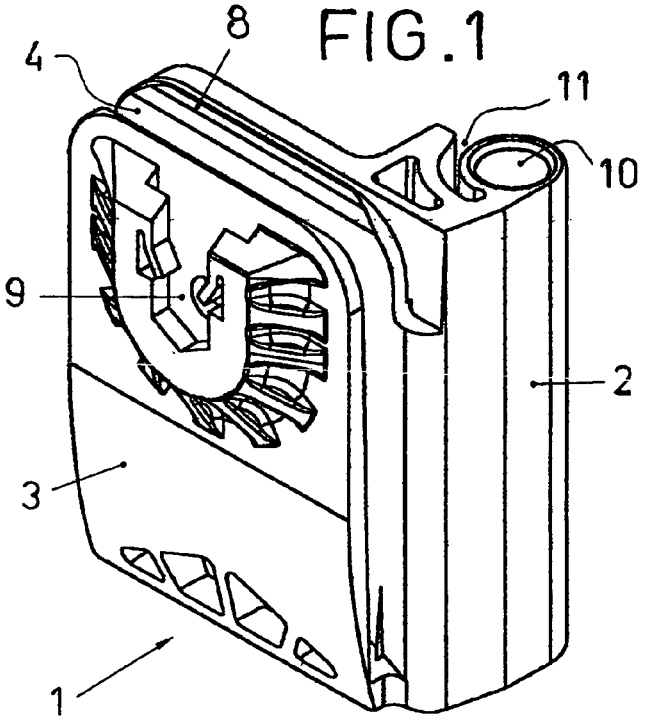
FIG. 1 is a perspective view of a driving member for power window devices of motor vehicles according to the present invention.

The driving member that is shown in the figures according to the present invention essentially comprises a body made of plastic or any other suitable material which has been generally indicated at (1) in FIG. 1.

Figure 3:
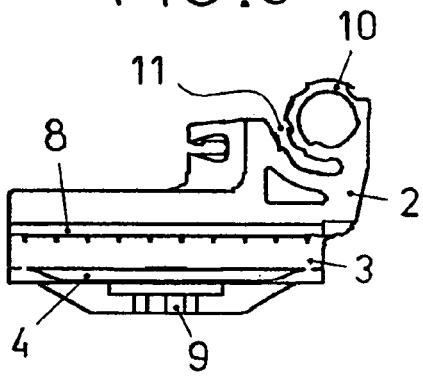
FIG. 3 is a front elevational view of the body of the driving member with both surfaces.

As it can be seen from FIG. 3 in the enclosed drawings, the body (1) of the driving member is a clamp-like U-shaped body. Thus, there are provided two body halves (2, 3) joined to each other by one of their ends, as shown in FIG. 4.

The interior portion (4) of the body (1) of the driving member is adapted to receive the lower edge of the window pane of the motor vehicle (not shown in the figures).

Figure 4:
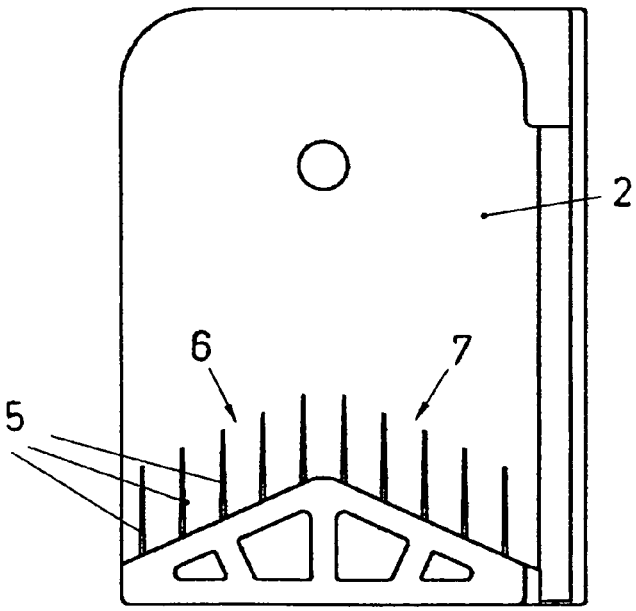
FIG. 4 is a plan view of the lower body half without the upper body half so that the protrusions in the driving member may be seen.

Referring to FIG. 4 of the drawings enclosed in the present specification, the interior portion (4) of the body (1) of the driving member which is in contact with the lower end of the window pane of the motor vehicle is provided with parallel longitudinal protrusions referenced by (5) which are emerging from the body half (2) of the driving member. These parallel longitudinal protrusions (5) are disposed in a stepped arrangement forming an upward series of protrusions (6) and a downward series of protrusions (7). Both series (6, 7) of protrusions (5) are symmetrical.

The window pane rests on one of said series (6, 7) slightly sloped according to the position that it assumes in the power window device. The symmetry of the series (6, 7) of protrusions allows to use the same driving member for the window pane of the door of either side of the vehicle, the lower edge of the window pane either resting on one or another series (6, 7) of protrusions (5).

Protrusions (5) further allow reducing the existing tolerances between the surface of contact of the window pane and the driving member, the window pane being correctly adjusted in the interior portion (4) thereof.

As it can be seen from FIGS. 1 and 3 of the drawings, the body half (2) includes a frontal transverse groove (8). Said groove allows conforming resiliently the end of the body (1) of the driving member where the window pane exists to the curvature of the window pane thereof without forcing the geometry of said body (1) of the driving member.

The body half (3) of the body (1) of the driving member is provided with a cavity (9) to receive a nut (not shown). Said nut is mounted fitted within said cavity (9) matching a hole formed in the lower end of the window pane (not shown). A screw that holds the window pane caught between the two body halves of the driving member may pass through both holes. The inner diameter of the nut of the body half (3) of the driving member is smaller than the hole of the window with the purpose of absorbing tolerances between rails.

Figure 2:
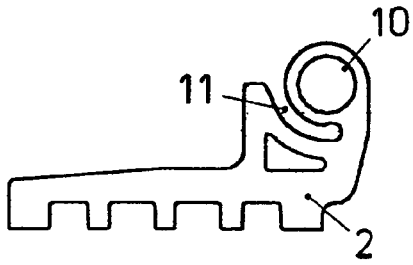
FIG. 2 is a front elevational view of one of the two surfaces defining the body of the driving member.

According to FIGS. 1, 2, 3, the body (1) of the driving member for power window devices of motor vehicles that is herein described is provided with an end of travel stop (10) arranged centered with the stop of the power window device and the section of the guide rail in such a way that, although the driving member is rotated, the stop remains centered. The end of travel stop (10) is cylindrical in shape and it is positioned adjacent to a semicircular longitudinal groove (11) where the rail of the power window device runs.

Once having been sufficiently described what the driving member for power window devices of motor vehicles of the present invention consists according to the enclosed drawings, it is understood that any detail modification can be introduced as appropriate, provided that variations may alter the essence of the invention as summarised in the appended claims.

What is claimed is:

1. A driving member for a power window device of a motor vehicle comprising a U-shaped body (1) formed of two body-halves (2, 3) joined to each other at one of their ends, the body halves defining an interior portion (4) adapted to receive a lower end of a window pane of the vehicle, said U-shaped body (1) adapted to be slidingly driven by a driving cable along a rail of said power window device, said interior portion (4) of said body (1) for contacting the lower end of the window pane of the vehicle being provided with parallel longitudinal protrusions (5) disposed in a stepped arrangement forming a first series of protrusions (6), each of said protrusions of said first series having a distal end disposed in said interior portion, the distal ends of said protrusions of said first series forming a slope extending upwardly from a first side of said body toward a longitudinal centerline of said body and a second series of protrusions (7), each of said protrusions of said second series having a distal end disposed in said interior portion, the ends of said protrusions of said second series forming a slope extending downwardly from the longitudinal centerline of said body toward a second side of said body opposite said first side, both of said series (6, 7) of protrusions (5) being symmetrical about said centerline so that the window pane is adapted to rest on one of said series (6) slightly sloped according to a position that the window pane assumes in the power window device depending on which side of the vehicle the body is used.

2. The driving member for a power window device of a motor vehicle according to claim 1, characterized in that one of the body halves (2) defining said U-shaped body has a front transverse groove (8) adapted to resiliently conform an end of said body (1) where the window pane will be disposed to a curvature of the window pane.

3. The driving member for a power window device of a motor vehicle according to claim 2, characterized in that the other one of the body halves (3) is provided with a hole for matching a hole formed in the lower end of the window pane for attaching the driving member to the window by a screw, the hole of the driving member being smaller than the hole of the window pane.

4. The driving member for a power window device of a motor vehicle according to claim 3, characterized in that the driving member is provided with a travel stop (10).

5. The driving member for a power window device of a motor vehicle according to claim 1, characterized in that one of the body halves (3) is provided with a hole for matching a hole formed in the lower end of the window pane for attaching the driving member to the window pane by a screw, the hole of the driving member being smaller than the hole of the window pane.

6. The driving member for a power window device of a motor vehicle according to claim 1, characterized in that the driving member is provided with a travel stop (10).

* * * * *